US008591275B2

(12) United States Patent
Gonsalves et al.

(10) Patent No.: US 8,591,275 B2
(45) Date of Patent: Nov. 26, 2013

(54) WATER SPORT FLOTATION GARMENT

(76) Inventors: Dennis James Gonsalves, Manteca, CA (US); Kathleen Cecilia Gonsalves, Manteca, CA (US)

( * ) Notice: Subject to any disclaimer, the term of this patent is extended or adjusted under 35 U.S.C. 154(b) by 117 days.

(21) Appl. No.: 13/157,406

(22) Filed: Jun. 10, 2011

(65) Prior Publication Data

US 2012/0149261 A1 Jun. 14, 2012

Related U.S. Application Data

(60) Provisional application No. 61/422,897, filed on Dec. 14, 2010.

(51) Int. Cl.
*B63C 9/08* (2006.01)

(52) U.S. Cl.
USPC ..... 441/106

(58) Field of Classification Search
USPC ..... 441/106, 107, 108, 114, 117, 115
See application file for complete search history.

(56) References Cited

U.S. PATENT DOCUMENTS

| | | | | | |
|---|---|---|---|---|---|
| 3,400,415 | A * | 9/1968 | Scheurer | 441/112 |
| 3,512,190 | A * | 5/1970 | Buff | 5/730 |
| 4,615,047 | A * | 10/1986 | Matsuoka | 2/50 |
| 4,619,622 | A | 10/1986 | McDonald et al. | |
| 4,864,656 | A * | 9/1989 | Nesse | 2/97 |
| 5,084,968 | A | 2/1992 | Trotta | |
| 5,295,765 | A | 3/1994 | Choi | |
| 5,413,348 | A | 5/1995 | Basso | |
| 5,759,076 | A * | 6/1998 | Bateman et al. | 441/115 |
| 6,328,618 | B1 * | 12/2001 | Fleischli | 441/106 |
| 2005/0101203 | A1 * | 5/2005 | Kemp | 441/106 |
| 2008/0090476 | A1 * | 4/2008 | Hamburg | 441/106 |

* cited by examiner

*Primary Examiner* — Stephen Avila
(74) *Attorney, Agent, or Firm* — Daniel Boudwin

(57) ABSTRACT

A personal flotation garment device is provided for facilitating balanced flotation of a snorkeler swimming in a horizontal alignment or floating vertically. The garment comprises a front portion, a back portion, two laterally opposed arm portions and a plurality of buoyancy pockets. The garment may be formed in the shape of a shirt having a zipper extending vertically along the bisected center of said front portion to allow a user to don the garment. Buoyancy pockets enclosing closed-cell foam material are symmetrically disposed about the front and back portions. These buoyancy elements are balanced to allow a snorkeler to comfortably swim face down in a body of water. The garment may be constructed of an insulating layer and an elastic liner to promote contoured fit that provides thermal retention and UV protection.

10 Claims, 4 Drawing Sheets

WATER SPORT FLOTATION GARMENT

CROSS REFERENCE TO RELATED APPLICATION

This application claims the benefit of U.S. Provisional Application No. 61/422,897 filed on Dec. 14, 2010, entitled "Snorkel Shirt."

BACKGROUND OF THE INVENTION

1. Field of the Invention

The present invention relates to water safety device, more specifically it relates to a flotation garment for providing balanced buoyancy to a snorkeling user.

Vacationers in tropical locales often enjoy the activity of snorkeling. Participation in this activity requires a user to swim at a leisurely pace with their face in the water. A mask is worn to increase visual acuity underwater, and a snorkel tube is placed in a user's mouth to allow breathing while the user's face is submerged. The activity is not overly strenuous, but may be difficult for participants who are not strong swimmers or are not comfortable in deep water. Individuals who are anxious about swimming in deep water may choose to use a life vest or other personal buoyancy device in order to keep their body afloat.

The personal buoyancy device most commonly available to the casual swimmer is the life jacket. Life jackets typically comprise front and back portions of buoyant material covered by a water-safe material. This vest is secured to a user by a set of clips and straps that extend across a user's midsection. The vest may be filled with a buoyant material such as foam, rubber, plastic, or other material that may be suitably buoyant or inflatable. These devices are designed to provide sufficient buoyancy to keep a user's upper body and face out of the water. Snorkelers and water sport enthusiasts may find this degree of buoyancy problematic, because it reduces the user's ability to swim face down in the water, float low in the water or dive deep underwater.

Life Jackets present additional problems. They are often unbalanced, having high buoyancy material distributed along the upper chest and shoulders. These structures makes it easy for a user to float vertically in water, but can be very cumbersome to those attempting to swim in a horizontal fashion, or to dive deep underwater while wearing the jacket. In addition to the amount of buoyancy, the bulk and inflexibility of common life jackets forces users to swim unnaturally or uncomfortably. Arm motions must be altered or exaggerated to accommodate the size of the armholes in the life jacket, and the head must be turned at angles that may be uncomfortable in order to see forward. The additional effort expended by swimming in a life jacket may result in a user tiring more rapidly than they normally would, developing cramps, or the material of the jacket abrading a user's skin.

Some snorkelers and water sport enthusiasts choose to wear a t-shirt underneath their life jacket in order to prevent abrasion to the skin. This method does alleviate some dermal rubbing; however neither a t-shirt nor a life jacket provides any thermal insulation to users swimming in cooler water, nor do they provide uniform protection from the sun's UV radiation. A personal buoyancy device is needed that provides snorkelers and water sports enthusiasts with comfortable, flexible, and balanced buoyancy that allows a user to swim in a horizontal position or float vertically, as well as provide adequate buoyancy without limiting occasional underwater in varying depths of water.

2. Description of the Prior Art

The prior art contains a variety of flotation garment devices for providing buoyancy to a user while swimming or snorkeling. These devices have familiar design and structural elements for the purposes of assisting with flotation of a swimming user; however they are not adapted for the task of providing a user with balanced buoyancy elements that promote flotation in a horizontal or vertical alignment. Nor do does the prior art contemplate a rash resistant material providing UV protection to the skin of a user. Further, the prior art does not contemplate snorkeling activities, which entail periods of flotation punctuated by the occasional underwater dive.

McDonald et al., U.S. Pat. No. 4,619,622 discloses a safety swimsuit having a plurality of buoyancy elements. The suit comprises a tank style shirt removably affixable to a pair of shorts or bikini bottoms, by means of hooking fasteners. Said shirt having multiple waterproof pockets vertically or horizontally disposed along the front and back face of the shirt. Said pockets are filled with Styrofoam pellets, and alternatively may be hollow and inflatable. The inflatable buoyancy pockets may be filled with or evacuated of air by utilizing attached valves. Buoyant foam padding is not disclosed as an optional filler material for the waterproof pockets. This patent is directed to a life preserver device, as opposed to a snorkeling or water sport garment that provides buoyancy combined with activewear. The present invention provides a garment that facilitates both buoyancy and improved capability with regard to the activity at hand, namely snorkeling or similar water sport activity. The proposed garment is equipment that does not impede the desired activity, while still providing a degree of buoyancy for safety and security purposes.

Michalochick, U.S. Pat. No. 5,184,968 discloses a buoyancy swimsuit having a large buoyant element. Said buoyancy element comprises a front and a back portion and two shoulder portions. The shoulder portions extend from the front of the garment to the back, over the top of a user's shoulders. Front and back portions cover the forward and rearward upper torso. A two-ply material encloses the buoyancy elements. The elements may be constructed of foam rubber or foam plastic. Michalochick discloses that the buoyant elements are larger towards the front and shoulders to prevent a user's face from being immersed in water. The present invention provides for buoyancy elements appropriately spaced along the torso of a user to facilitate balanced flotation while swimming in all orientations, including upright, face down or while diving in water. Michalochick discloses a swimsuit having a lower pants portion, not a body-hugging shirt for providing light buoyancy while snorkeling and appropriate articles for water sport activities. Additionally, the instant invention does not require a two-ply elastic mesh material for the construction of the snorkeling shirt.

Adee, U.S. Pat. No. 5,413,485 discloses a method for teaching a person how to swim buy placing the student in a swimsuit having elements of variable buoyancy attached to the front of said swimsuit, placing the student chest down in a pool, and instructing the student on proper swimming technique. The present invention discloses foam filled pockets along the back and front of a shirt, not a swimsuit having variable buoyancy elements, or a method utilizing such a device for swimming education. Adee also does not disclose foam filling or buoyancy elements on the back of a shirt.

Choi, U.S. Pat. No. 5,295,765 discloses a flotation vest for providing buoyancy for a user while swimming or snorkeling. The swim vest comprises an upper body shirt having a series of straps for removably securing an inflatable bladder, and a lower body portion removably secured to said upper body shirt by a fastening means. The buoyancy element of Choi is a variably inflatable bladder that receives and expels air by means of a valve disposed on its exterior. Choi does not disclose the use of foam material for providing buoyancy to a snorkeling user. Additionally the bladder of Choi may be removably secured to varying places along the surface of the upper body device, while the present invention contemplates permanently affixed pockets of buoyant material within a zippable sportswear garment, particularly suited for snorkeling activities and occasional underwater diving.

The devices disclosed by the prior art do not address the need for buoyancy elements balanced in a manner that promotes both horizontal and vertical flotation of a swimming user. Nor do the prior patents provide a garment particularly suited for deep water snorkeling, which requires adequate buoyancy to stay afloat for long periods of time in open water, while not inhibiting diving activities from the surface of the water. The prior patents similarly do not address the need for a flotation garment that provides rash and UV protection for the skin of a user. The current invention relates to a device for providing buoyancy to a user while he or she is snorkeling. It substantially diverges in structural elements from the prior art; consequently it is clear that there is a need in the art for an improvement to the existing flotation garment devices. In this regard the instant invention substantially fulfills these needs.

SUMMARY OF THE INVENTION

In view of the foregoing disadvantages inherent in the known types of flotation garments now present in the prior art, the present invention provides a new flotation garment wherein the same can be utilized for providing convenience for a user desiring vertical or horizontal flotation when snorkeling, along with defined pockets of buoyant material to facilitate both open water floating and occasional diving. The garment comprises a front portion, a rear portion, two arm portions, and a plurality of buoyancy pockets. A rash guard shirt is contemplated having a varying number of buoyancy pockets disposed about its forward and rearward surfaces. Said buoyancy pockets enclose a closed-cell foam material that is highly buoyant in water. In a preferred embodiment, the garment may have several square buoyancy pockets positioned near the chest and stomach of said front portion, and several rectangular buoyancy pockets positioned along the rear portion.

When a user dons the flotation garment and enters a body of water, the foam material promotes flotation by providing buoyant force. The pockets are positioned in a manner that promotes balanced flotation of a user in either a vertical, resting position or in a horizontal, swimming position. To achieve balanced flotation, placement and size of the pockets may vary according to the size of the garment and whether the user is a male, female, or child. Flexibility in options for comfortable flotation facilitates confidence in users, who are free to snorkel at their own pace knowing that they will be able to swim or rest with reduced risk of being submerged. Varying levels of buoyant material may be included for different sized users and swimming skill levels if desired. Ideally, the present invention provides a buoyant sport shirt that allows easier flotation, while providing overcomeable resistance when diving under the surface.

In the preferred embodiment, the shirt is made of neoprene insulation and a layer of material that reduces friction between the skin and shirt in order to reduce dermal abrasion. The shirt may be constructed as a rash guard. Rash guards have flat seams to further alleviate friction against the skin. Additionally they provide an increased level of UV protection. These features are highly beneficial to a snorkeler whose skin may be exposed to sunlight and salt water for extended periods of time while in the water. The use of a rash guard in constructing the flotation garment provides a user with a lightweight, comfortable layer of protection and additional buoyancy while snorkeling.

In a similar embodiment, the shirt may be constructed entirely of neoprene, with a second layer of neoprene creating a pocket for which to place buoyant material. The second layer is placed along the interior side of the shirt, reducing its visual signature from an external user and reducing the size of the pocket bump-out.

It is therefore an object of the present invention to provide a new and improved flotation garment device that has all of the advantages of the prior art and none of the disadvantages.

Another object of the present invention is to provide a new and improved flotation garment device having a plurality of foam filled buoyancy pockets disposed along its back and front sides.

Yet another object of the present invention is to provide a new and improved flotation garment device constructed of a fabric that provides strong ultraviolet radiation protection to a wearer.

Still another object of the present invention is to provide a new and improved flotation garment device providing a user with buoyancy sufficiently balanced to allow said user to swim in any orientation while in the water, while providing so with minimal buoyancy to allow underwater diving events between periods of surface swimming.

Yet another object of the present invention is to provide a new and improved flotation garment device wherein the preferred embodiment includes a layer of insulation material for facilitating retention of thermal energy by a user swimming in cool water.

A further object of the present invention is to provide a new and improved flotation garment device having durable and resilient construction.

Other objects, features and advantages of the present invention will become apparent from the following detailed description taken in conjunction with the accompanying drawings.

BRIEF DESCRIPTIONS OF THE DRAWINGS

The above invention will be better understood and the objects set forth above as well as other objects not stated above will become more apparent after a study of the following detailed description thereof. Such description makes use of the annexed drawings wherein.

DETAILED DESCRIPTION OF THE INVENTION

Figure 1:
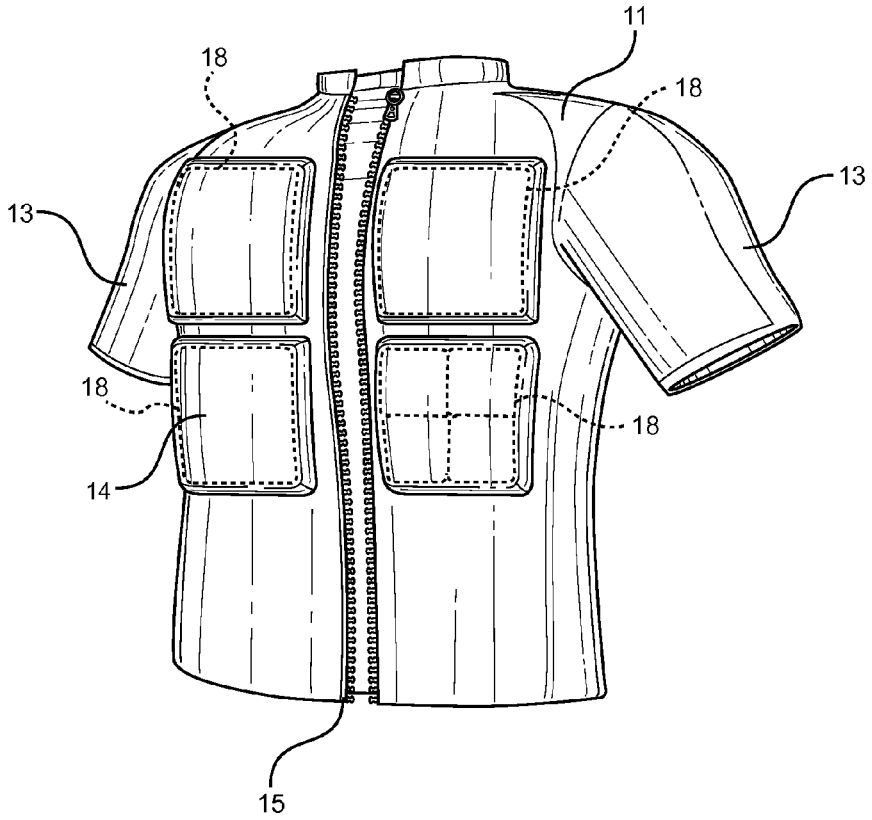
FIG. 1 shows a frontal perspective view of the preferred embodiment of a flotation shirt according to the present invention.

Reference is made herein to the attached drawings. Like reference numerals are used throughout the drawings to depict like or similar elements of the flotation garment device. For the purposes of presenting a brief and clear description of the present invention, the preferred embodiment will be discussed as used for providing buoyancy to a snorkeling user. The figures and description thereof is intended for representative purposes only and should not be considered to be limiting in any respect.

Figure 2:
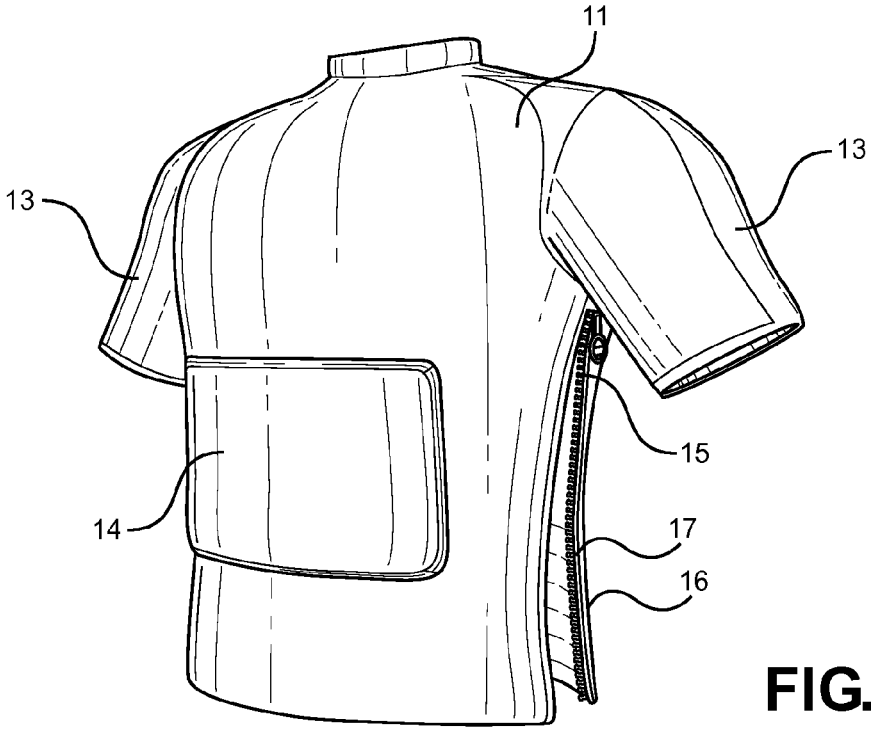
FIG. 2 shows a frontal perspective view of an alternate embodiment of a flotation shirt according to the present invention.
Figure 3:
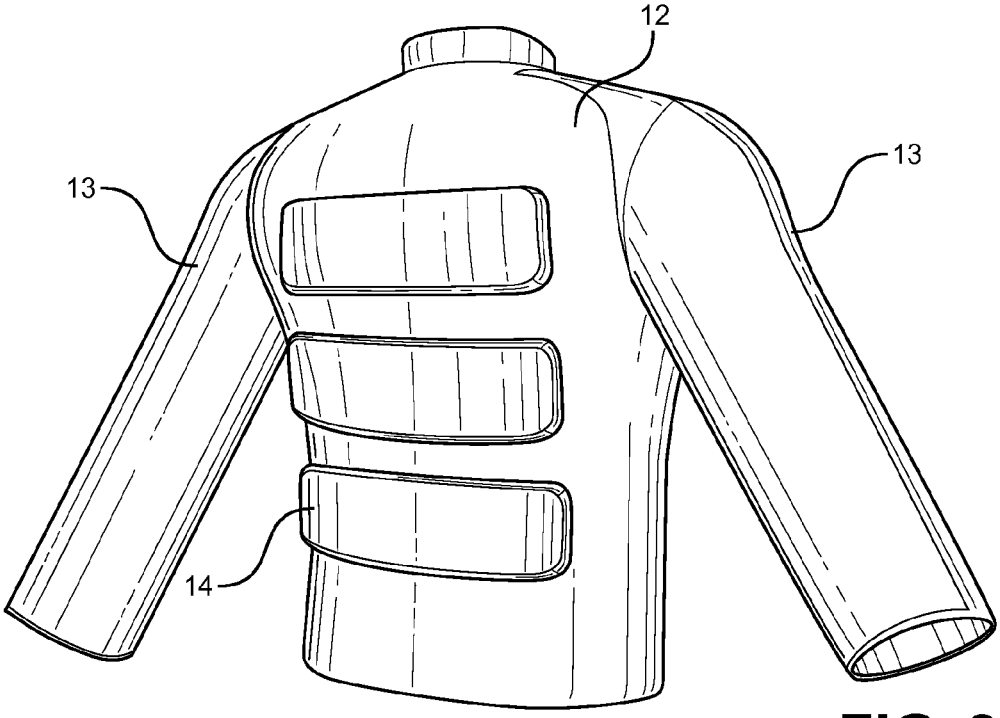
FIG. 3 shows a rear perspective view of a flotation shirt according to the present invention, wherein said shirt has a several flotation cells displayed.

Referring now to FIGS. 1-3, there is shown a flotation garment worn by a user while snorkeling. Said garment comprises an elastic upper body cover having a front portion 11, a back portion 12, two arm portions 13, and a plurality of buoyancy pockets 14. The garment may be formed in the shape of a short sleeve or long sleeve shirt, or in a particular embodiment without sleeves, having a variety of design configurations. Said front and back portions 11, 12 extend horizontally from a first side of a user's torso to the opposing side of the same, and vertically from the user's neck to his or her hips. The exact length and width may vary, and the neckline may be high, crew or any other desired cut. The front and back portions 11, 12 may be formed together or may be separate and permanently secured at their corresponding horizontal ends. The arm portions 13 are formed in the shape of sleeves and are secured to the front at back portions at the top of laterally opposing ends. The sleeves 13 may be of variable length to provide thermal insulation and UV protection as necessitated by environmental conditions. Alternatively, the present invention may be provided in a sleeveless form.

To allow a user to easily don or remove the garment a sliding fastener 15 such as a zipper may be secured in the center of the front portion 11 or along a side between the front and rear portions. If the fastener 15 is positioned along the center of the garment's front portion 11 then the fastener extends vertically from the top end to the bottom end of the shirt, bisecting the front portion in two parts. Buoyancy pockets 14 are disposed symmetrically on opposing sides of the sliding fastener 15. Alternatively the fastener may be disposed along one side of the garment at the junction between the front and back portions 11, 12. The side fastener extends from the junction of the lower end of an arm portion 14 along the corresponding horizontal ends of the front and back portions 11, 12 to the bottom edge of the garment. Placement of the sliding fastener and construction of the same may vary depending on the construction of the garment, placement of buoyancy elements, and size of the target user.

Buoyancy pockets 14 are disposed along the front and rear portions of the garment. Said buoyancy pockets 14 comprise a layer of material permanently secured to the surface of the garment forming a preferably watertight recess. The pocket-forming layer of material may have the same cross-sectional composition as that of the underlying garment, discussed in following paragraphs. Enclosed within the recess is a geometrically shaped piece of closed-cell foam 18 material such as polyethylene. Unlike open-cell foam, closed-cell foam cannot be easily saturated by liquids and is thus resistant to sinking. The closed-cell foam is also superior to inflatable flotation cells because foam is more flexible and may conform to the contours of a user's body without exerting air pressure that may cause discomfort. The pocket-forming layer of material is fitted snuggly against the foam to prevent any air pockets or bulges from distorting the shape of the garment. Preferably, the pockets are placed on the interior of the garment, with the layer of material forming the pocket attaching internally thereto. This reduces the bulge associated with the pocket, as the surface of the shirt compresses the pocket as its surface is stretched while being worn. In a particular embodiment, the pockets provide an accessible enclosure, wherein the retained foam is removable and replaceable. In a particular embodiment, an opening, secured via a latch means such as hook and loop fastening or similar means, provides access to the foam within the pocket for inspection, replacement or removal thereof.

The foam provided within the pockets is designed to conform to the user's body while in use. In furtherance of this goal, a vertical and horizontal slit may be provided along a side of the foam, extending from the user side and directed outward. The vertical slit allows the outside of the foam to spread and further conform to the user's body contour at that specific region. This reduces the overall cross section of the foam, and its visual signature to outside observers, while preserving buoyancy provided therein.

The buoyancy pockets should be positioned along the front and back portions with respect to areas of a user that are generally denser, such as the upper chest or midsection. This alignment provides a more balanced flotation for users swimming horizontally. In the preferred embodiment, the garment may have up to four square buoyancy pockets 14 disposed along the middle section of the garment's front portion 11 (see FIG. 1), and between one and three buoyancy pockets 14 disposed along the back portion 12 (see FIG. 3). The size, thickness and position of the buoyancy pockets may vary according to the needs of a user, for instance a garment designed for an adult male may provide more buoyancy elements than one intended for a child. Likewise, athletic ability and swimming capability of the wearer may dictate varying levels of buoyancy.

Figure 4:
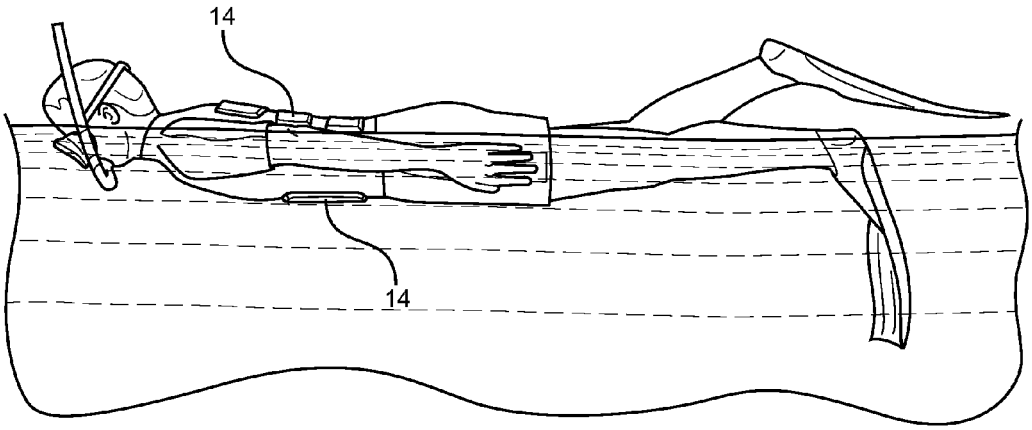
FIG. 4 shows a view of the present invention in use, wherein a user is swimming along the top surface of a body of water.
Figure 5:
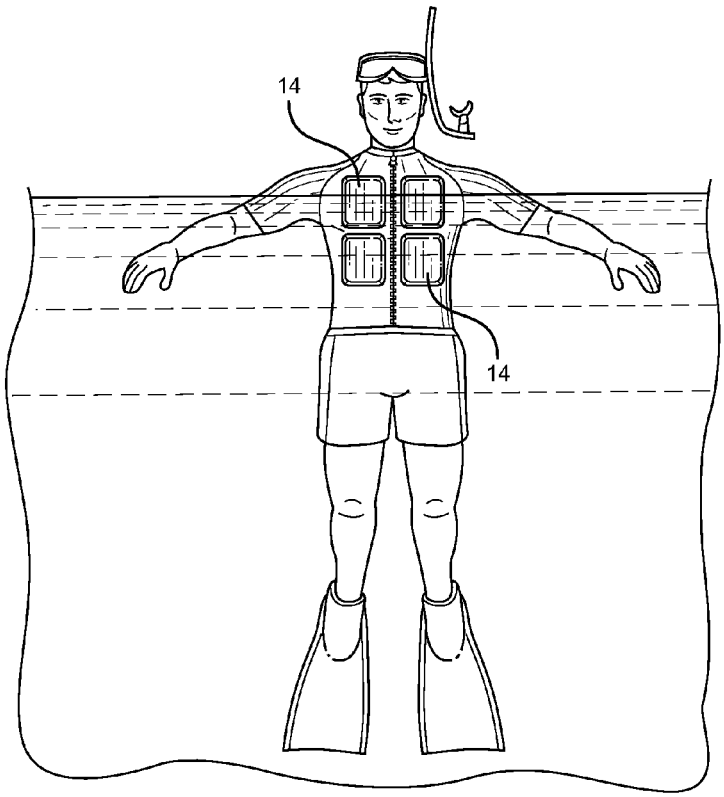
FIG. 5 shows a frontal view of a flotation shirt according to the present invention, according to the present invention, in use by a floating swimmer.
Figure 6:
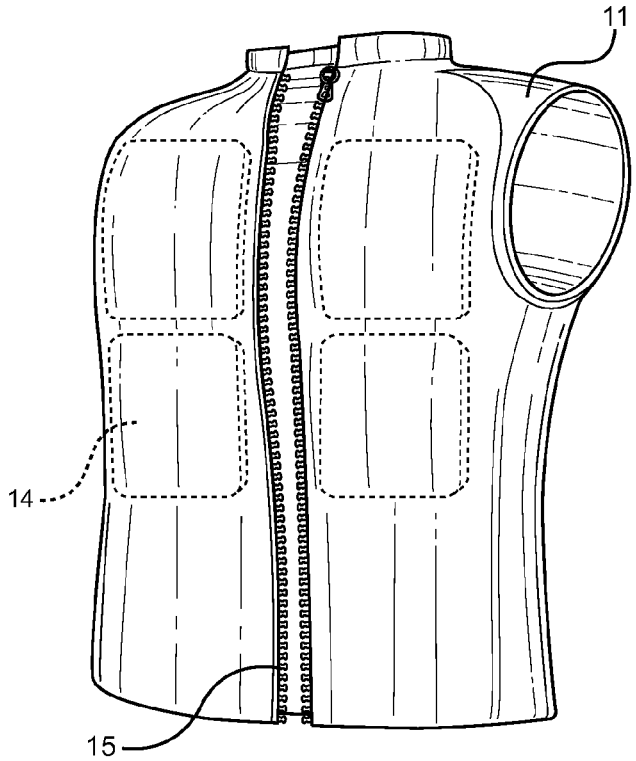
FIG. 6 shows a frontal view of a flotation shirt according to the present invention.
Figure 7:
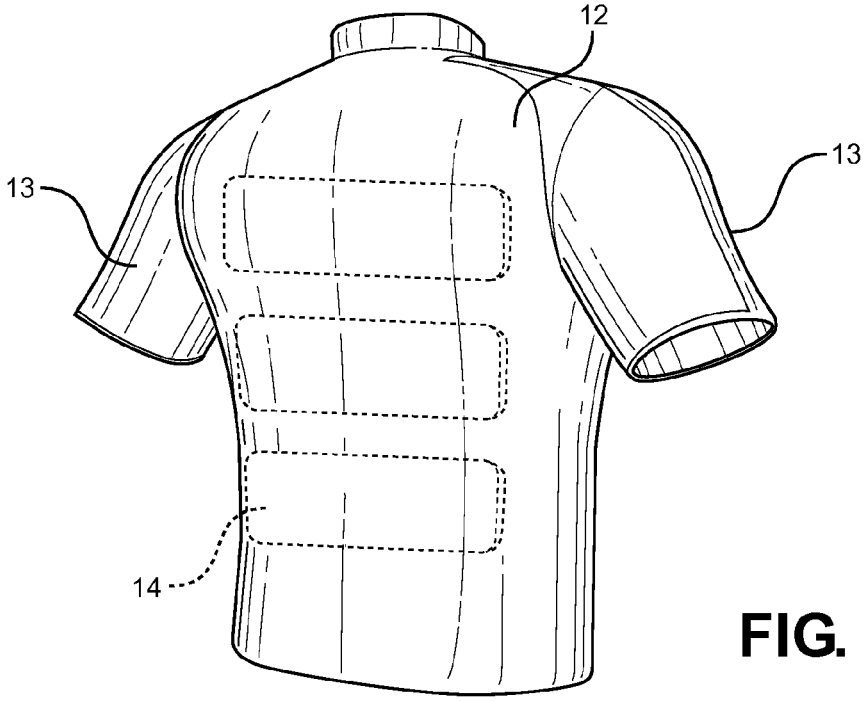
FIG. 7 shows a rear view of a flotation shirt according to the present invention.

Referring now to FIGS. 4 & 5, there is shown a user of the garment snorkeling along the surface of a body of water, and another while floating vertically. The balanced alignment of the flotation cells allows the user to remain comfortable while swimming face down in the water (see FIG. 4). The device provides buoyant force to a user who chooses to rest in a vertical position in between swimming (see FIG. 5). For shallow water snorkeling, a user may be able to stand on the ocean floor, utilizing the device only when swimming, while deep water snorkeling a user may be forced to float vertically for periods of time, in this manner the garment is suitable at any depth of water. The garment is not intended to restrict the user to the surface of the water, but rather to provide desired support to reduce treading exertion. The shirt may be utilized by snorkelers to both easily float along the surface with minimal effort, while likewise allowing underwater diving activities, which is common in snorkeling adventures and open water dives.

In an embodiment of the present invention, the garment itself is constructed of an insulating layer 16, such as neoprene, and a lining layer of elastic material 17 such as nylon or lycra that reduces friction between the skin and shirt to reduce dermal abrasion. Heavier weight liner materials may be used in garments intended for cold-water use. The liner layer material is elastic to promote a snug fit that causes the flexible flotation foam to conform to a user's body. A more contoured fit also reduces the need for awkward swimming movements that result in fatigue. The seams of the garment are secured with a watertight stitching, such as flat-lock stitching. By reducing the volume of water that enters the garment through the seams, the garment provides increased thermal retention to a user. The materials used in construction of the flotation garment may provide the same with a high UV protection rating such as a UPF higher than 80, to protect a user's skin from becoming sun burnt. This construction gives a user a lightweight, buoyant garment that is both comfortable and protective while snorkeling. The exact construction and materials used may vary according to the intended user and environmental conditions.

In use, an individual removes their upper body clothing, places their arms in the arm sleeve portions 13 or sleeve holes provided therefor in a sleeveless configuration, adjusts the positioning of the garment and then slides the fastener 15 into a position that secures the garment to the user. The user may then apply appropriate snorkeling gear, or likewise venture out into a body of water with only the buoyant garment donned. The balance of buoyant pockets disposed along the garment, a user may float in any position desired along the surface of the water. To snorkel, the user simply begins to swim slowly with his or her face in the water. The flotation garment will keep the user's torso floating in a balanced position. If desired, the user may choose to dive below the surface to a given depth, without being restricted by the buoyant pockets in the same manner as a life preserver or buoyant jacket. Therefore, the present invention provides a sport shirt, buoyancy assistant and a thermal/UV protective garment for use in any acceptable environment.

The provided garment provides a user with a buoyant garment that affords flotation in various situations, including support for different sport swimming events such as snorkeling, recreational swimming in deep water and offshore swimming wherein swimmer support is not readily available. The garment may be adorned with varying levels of buoyant material, providing for a plurality of skill level swimmers, including users with extreme swimming skill who still require flotation backup support, or for those users learning to swim who require assistance to stay afloat. It is not intended for the present invention to provide a life preserving or life saving means, particularly one that may achieve Coast Guard approval and one that is designed to upright an unconscious user. Conversely, it is desired to provide a user with a garment that inspires confidence in deep water situations, one that aids buoyancy in active swimming sports and provides a means for buoyancy for beginning swimmers where necessary.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim the following:

1. A personal floatation sport garment, comprising:

a front shirt portion secured to a back shirt portion along corresponding horizontal edges, said front and back shirt portions enclosing a user's upper torso and extending from a user's neck to his or her hips; and two arm portions laterally opposed and secured to said front and back shirt portions; and a sliding fastener for securing said garment to a user; and wherein said garment is constructed of an insulating layer, along with an inner liner layer attached to the inner surface of said insulating layer;

a plurality of buoyancy pockets disposed along the interior of said front shirt portion and said back shirt portion and tightly enclosing sections of closed cell foam, wherein said pockets are watertight and sealed around the perimeter of each section of closed cell foam;

said buoyancy pockets comprising a secondary layer of shirt material attached to said front or back shirt portion; and wherein said secondary layer is attached to an interior surface of said front or back shirt portion.

2. The garment of claim 1, wherein said fastener is positioned vertically along a central region of said front shirt portion, bisecting said front portion into a first and second section and securing the same together.

3. The garment of claim 1, wherein between two and four buoyancy pockets are symmetrically disposed along said front shirt portion.

4. The garment of claim 1, wherein between one and three buoyancy pockets are disposed along said back shirt portion.

5. The garment of claim 1, wherein said insulating layer comprises neoprene.

6. The garment of claim 1, wherein said inner layer comprises nylon.

7. The garment of claim 1, wherein said arm portions are short sleeves, ending prior to the user's elbow.

8. The garment of claim 1, wherein said arm portions are long sleeves, ending beyond the user's elbow.

9. The garment of claim 1, wherein said arm portions are sleeveless, merely providing an opening for a user's arm to protrude.

10. The garment of claim 1, wherein said enclosed buoyant material comprises a vertical and horizontal slit along a surface contacting a user, said slits providing conformity along said user's body.

* * * * *